US006625561B1

(12) United States Patent
Tullis

(10) Patent No.: US 6,625,561 B1
(45) Date of Patent: Sep. 23, 2003

(54) METHOD AND APPARATUS FOR MEDIA HEIGHT SENSING

(75) Inventor: Barclay J Tullis, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 196 days.

(21) Appl. No.: 09/685,157

(22) Filed: Oct. 10, 2000

(51) Int. Cl.[7] ..... H04N 1/04
(52) U.S. Cl. ..... 702/128
(58) Field of Search ..... 702/128; 358/1; 399/322, 389, 393; 73/504, 514; 216/2; 347/140; 250/561; 400/708; 271/145, 148

(56) References Cited

U.S. PATENT DOCUMENTS

| | | | | |
|---|---|---|---|---|
| 4,508,332 A | | 4/1985 | Nishio | 271/118 |
| 4,734,747 A | | 3/1988 | Okuda | 355/14 |
| 5,486,903 A | * | 1/1996 | Kanno et al. | 399/322 |
| 5,721,627 A | * | 2/1998 | Kamiya | 358/496 |
| 6,100,993 A | * | 8/2000 | Eom | 358/1.14 |

* cited by examiner

*Primary Examiner*—John Barlow
*Assistant Examiner*—Tung Lau

(57) ABSTRACT

The present invention employs an inexpensive method and apparatus for media height sensing. A sheet fed media-using-machine has a media holder. The media holder holds a stack of a variable quantity of sheets of a medium to be supplied to a media-using-machine. The media holder has a structure for supporting the sheets and has a stack pusher which may be a mechanical device that pushes the stack into a position such that said media-using-machine may withdraw the sheets from said stack. The stack pusher has a variable position within a range of motion wherein such position is dependent upon a quantity of sheets in the stack. A variable device is attached to the stack pusher such that an electrical property of said variable device varies in relation to said position thereby allowing calculation of an estimate of the quantity of sheets in said stack, where the calculation is performed using said electrical property. The variable device may be, for example, a capacitor or a resistor, and the electrical property being capacitance or resistance, respectively.

33 Claims, 16 Drawing Sheets

METHOD AND APPARATUS FOR MEDIA HEIGHT SENSING

FIELD OF THE INVENTION

The present invention relates to an inexpensive method and apparatus for sensing the height of a stack of media sheets, such as paper, used by media-using-machines such as desk top printers, fax machines, and the like, that are sheet fed from a media holder such as an input hopper or tray.

BACKGROUND ART

There are a variety of media-using-machines that are fed from a stack of sheets of media. For example, desktop printers, fax machines, and text scanning machines typically operate in this fashion with the media being paper, plastic for transparencies and so forth. The media stack is held in input hoppers or trays which may be removable or built-in.

FIG. 1 is a perspective view which shows a prior art sheet fed media-using-machine 20. Machine 20 has a media holder 22 and is fed with media sheets 24 which are held in media holder 22. In FIG. 1, media holder 22 is illustrated as a tray but other embodiments, such as a slot into which a stack of media sheets 24 are directly placed may also be employed. Media holder 22 is inserted into holder slot 26 and is thus housed within or attached to machine 20. Media holder 22 is illustrated as a removable tray in which media sheets 24 form a media stack. Media sheets 24 move in the direction of arrow 22A and are fed into media-using-machine 20. Media sheets are withdrawn sheet-at-a-time (sheetwise) from what is referred to as the top of a stack. Media sheets 24 are processed within machine 20, such as by printing upon the media or optically scanning the media, and are ejected from media eject opening 28 in the direction of arrow 28A to be deposited into the pickup hopper location of sheet 24A. Machine 20 has within it a control system 29 for controlling the operations of machine 20 that are described in this paragraph.

In prior art desktop printers, if the media holder 22 becomes empty such as resulting from normal use of all media sheets 24 that are held in media holder 22, then control system 29 may cause an audible or visible signal (not shown) on machine 20 to activate. An operator using machine 20 may notice the alert signal, realize that no media sheets 24 remain in media holder 22 and then refill media holder 22 with additional media sheets 24. Alternatively, or in addition to the foregoing signal, if in the process of printing a print job the printer is depleted of paper, then control system 29 may cause a message to appear on a display, such as a message to the effect "the printer is out of paper, do you wish to continue ( ) yes, or ( ) no?" This message is accompanied by a pause in machine operation since no media sheets 24 remain in media holder 22. Once the operator has refilled media holder 22 and replaced it in holder slot 26, the operator may click a computer mouse in the "yes" location and proceed with the print job. Alternatively, the operator may cancel the job. Alternatively, the machine 20 may automatically sense that the media holder 22 is no longer empty and begin to continue a print job.

FIG. 2 is a cut-away view which provides further details of the prior art media holder 22. In this and in other figures described in this specification, like numerals are identified with like reference numbers. Media holder 22 provides a structure for supporting media sheets 24, with the structure comprised of tray bottom 30A which provides a common supporting structure for the sides of media holder 22. These sides are front side 30B, right side 30C, back side 30D, and left side 30E (not shown). Media sheets 24 are stacked into media holder 22 with tray bottom 30A providing vertical support to the sheets and with sides 30B, 30C, 30D, and 30E providing a structure to retain media sheets 24 stacked in a vertical column of sheets, one atop the another. The front side 30B is "front" with reference to flow of media sheets 24 from media holder 22, that is, as media sheets 24 are fed from media stack 24 into the media processing areas of machine 20, such media sheets 24 flow past front side 30B. Right side 30C and left side 30E are right and left, respectively, with reference to view in the direction of media feed direction, illustrated by arrow 22A. The back side 30D is the side that is opposite the front side.

Stack pusher 32 is disposed to provide a mechanical pushing force to push media sheets 24 (the media stack) into a position such that machine 20 may withdraw the sheets from the stack. Stack pusher 32 consists of pusher plate 32A, pusher base 32B, hinge 32C, and spring 32D. Pusher plate 32A is pivotally connected by hinge 32C to pusher base 32B. Spring 32D provides a compressive force to urge pusher plate 32A away from pusher base 32B. Pusher base 32B may be attached to tray bottom 30A, or tray bottom 30 may serve as pusher base 32B. This urging force of spring 32D causes pusher plate 32A to push media sheets 24 into a position that machine 20 may withdraw the sheets from the stack. It should be noted that while the illustration shows spring 32D pushing pusher plate 32A, the prior art includes springs disposed to exert tensile force pull to pusher plate 32A, and the prior art includes rotational forces to torque pusher plate 32A, all to provide the same result of pushing media stack 24.

FIG. 3 is a perspective view of the prior art media holder 22 of FIG. 2. In this view, right side 30C, back side 30D, and left side 30E are attached to tray bottom 30A. Window 30F is provided on back side 30D. Window 30F is a vacancy or an aperture which is provided to allow a user of machine 20 to determine the presence or absence of media sheets 24 in media holder 22, or to estimate the number of media sheets 24 in media holder 22, without the need for withdrawing media holder 22 from holder slot 26. Thus window 30F provides a convenient way of ascertaining the amount of media sheets 24 in media holder 22. A limitation of window 30F is that it does not provide quantity information to control system 29. Another limitation of window 30F is that it requires the active attention of the operator of machine 20, that is, the operator must pay attention to window 30F. Yet another limitation is that machine 20 must be positioned or oriented on a desk or table such that the window is easily within view. In practice, when media sheets 24 are fully depleted, machine 20 stops operation. The view provided by window 30F becomes simply a confirmation of what the operator already expects when machine 20 stops operation, that is, confirmation that media holder 22 is indeed empty with the convenience being that confirmation can be performed without withdrawing media holder 22 from machine 20 for inspection.

FIG. 4 is a perspective view of a prior art media holder 22 with some differences to that illustrated by FIG. 3. In FIG. 4, pusher plate 32A has tabs 36A which project into slots 36B. Slots 36B are indentations, grooves, or the like, that are built into right side 30C and left side 30E. Tabs 36A and slots 36B allow pusher plate 32A to change position in a constrained translational motion fashion in contrast to the rotational motion featured by prior art media holders 22 of FIGS. 2 and 3 having a hinge 32C allowing constrained rotational movement of pusher plate 32A.

FIG. 4 also illustrates indicator mechanism 38. Indicator mechanism 38 is a mechanism which is provided to allow a user of machine 20 to determine the presence or absence of media sheets 24 in media holder 22, or to estimate the number of media sheets 24 in media holder 22, without the need for withdrawing media holder 22 from holder slot 26. While indicator window 30F provided a direct viewing means, indicator mechanism 38 provides an indirect way of accomplishing the same result. Indicator mechanism 38 is comprised of indicator lever 38A having indicator end 38B which projects into window 30F. Indicator lever 38A has an opposite end, that is, a paper contact end 38C. Indicator pivot 38D is a pivot point that is supported by media holder 22, such as by side 30E or by holder bottom 30A. Indicator lever 38A is pivotally mounted on indicator pivot 38D Double arrow 38E indicates the two directions that paper contact end 38C can travel. As additional sheets of media are properly placed into media holder 22 with sheets positioned under paper contact end 38C, paper contact end 38C is pushed upward and the pivot/lever action causes indicator end 38B to move downward. The relatively downward positioned indicator end 38B shows the machine user that media holder 22 is relatively full of media sheets 24. Alternatively, indicator mechanism 38 can be located such that media sheets push paper contact end 38C downward. In this case, the indicator end 38B remains up until it falls downward as the last sheet is removed, i.e., only when the tray 22 becomes empty. In the examples of indicator mechanism just described, a spring exerting tensile or compressive force may be employed to bias indicator lever 38A towards a selected position with a counter-force being exerted by the stack of media sheets.

Unfortunately, the indicator mechanism 38 of FIG. 4 suffers from the same limitations as those of window 30F that were described in connection with window 30F of FIG. 3.

FIG. 5 is a cut-away view which provides further details of the prior art media holder 22 of FIG. 4. Note the tabs are identified with reference numeral 36A. It should also be noted that while spring 32D is illustrated as a compressed spring urging pusher plate 32A away from bottom 30A, an alternative spring is sometimes used in the prior art, and that alternative spring is a spring in tension, pulling pusher plate away from bottom 30A to accomplish the same result.

FIG. 6 illustrates an aspect of prior art media holders 22 in that media feed rollers 39 are illustrated. Media feed rollers 39 are part of the media feed mechanism of media-using-machine 20 and which are used to withdraw sheets from a stack of media sheets 24. Note that the stack pusher 32 is illustrated with pusher plate 32A relatively close to pusher base 32B. This corresponds to a media holder 22 that is relatively full of media sheets 24.

FIG. 7 illustrates an aspect of prior art media holders 22 similar to that illustrated by FIG. 6. In FIG. 7, stack pusher 32 is illustrated with pusher plate 32A relatively away from pusher base 32B. This corresponds to a media holder 22 that not relatively full of media sheets.

FIGS. 6 and 7 illustrate a media stack 24 in a rest position (FIG. 6) and in a lifted or pushed position (FIG. 7). No spring is shown for media pusher 32 of FIG. 7, and in this media pusher 32 the media stack 24 pushing force is provided by the rotation of a bar (not shown) located on tray bottom 30A and hinged about one of the edges of pusher plate 32A. The lifting bar rotates the pusher plate 32A upward until the media stack 24 is pressed against media feed rollers 39 of the media feed mechanism. The angle to which the bar rotates is therefore an indication of the quantity of sheets in media stack 24.

From the limitations in the prior art that are described above, it can be seen that it is desirable to improve the ways in which the user of a sheet fed machine can determine the quantity of sheets in the media holder of such a machine. Also, since there is constant effort by manufacturers of such machines to make machines that are inexpensive, it can be understood that provision of low cost ways to determine the quantity of sheets is a highly desired goal.

SUMMARY OF THE INVENTION

The present invention employs an inexpensive method and apparatus for sensing the height of a stack of media. A sheet fed media-using-machine has a media holder. The media holder holds a stack of a variable quantity of sheets of a medium to be supplied to a media-using-machine. The media holder has a structure for supporting the sheets and has a stack pusher which may be a mechanical device that pushes the stack into a position such that said media-using-machine may withdraw the sheets from said stack. The stack pusher has a variable position of displacement within a range of motion wherein such position is dependent upon a quantity of sheets in the stack. A variable device is attached to the stack pusher such that an electrical property, or other property that can be sensed of said variable device, varies in relation to the position thereby allowing determination of an estimate of the quantity of sheets in said stack, where the determination is performed using the electrical or other property. The variable device may be, for example, a capacitor or a resistor, and the electrical property being capacitance or resistance, respectively.

DETAILED DESCRIPTION

Figure 1:
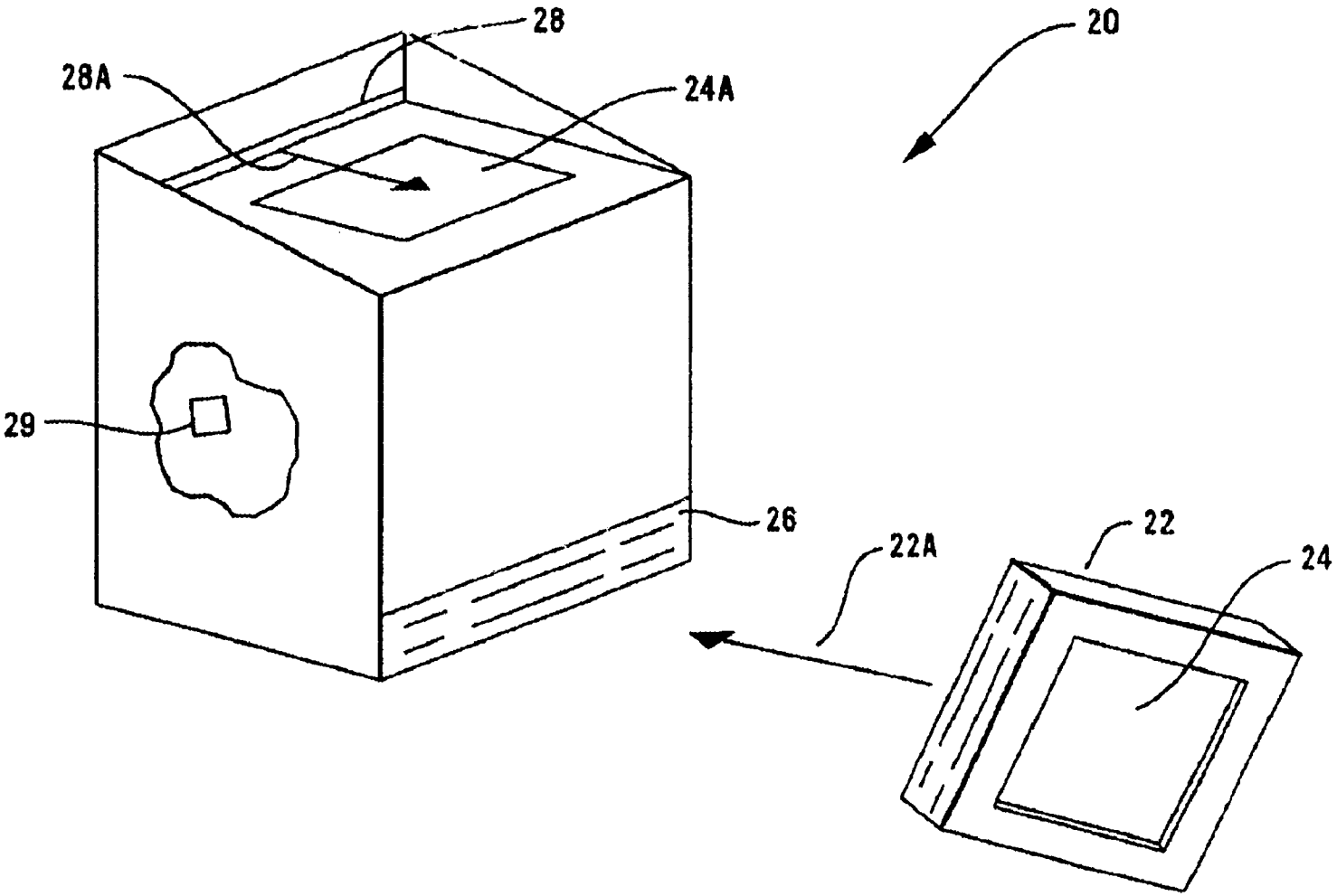
Figure 1 (PRIOR ART)
FIG. 1 is a perspective view which shows a prior art sheet fed media-using-machine.
Figure 2:
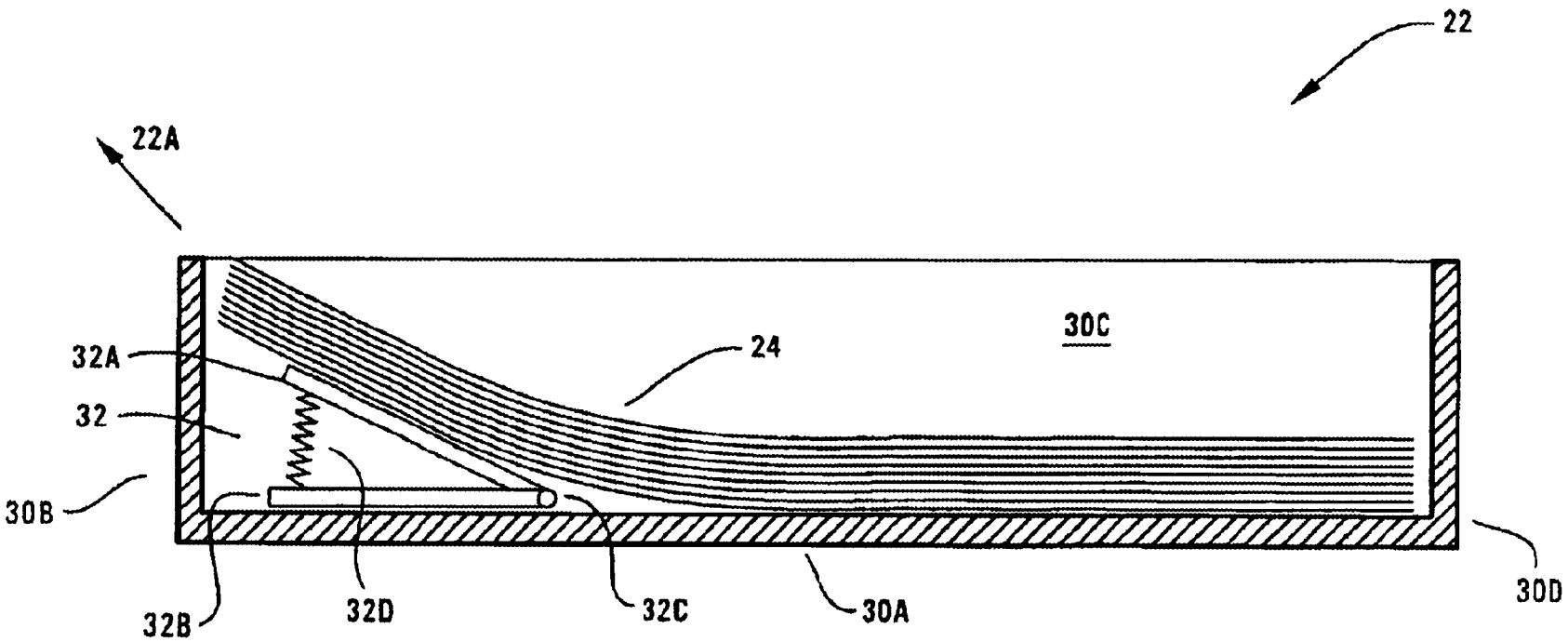
Figure 2 (PRIOR ART)
FIG. 2 is a cut-away view which provides further details of the a prior art media holder used with the media-using-machine of FIG. 1.
Figure 3:
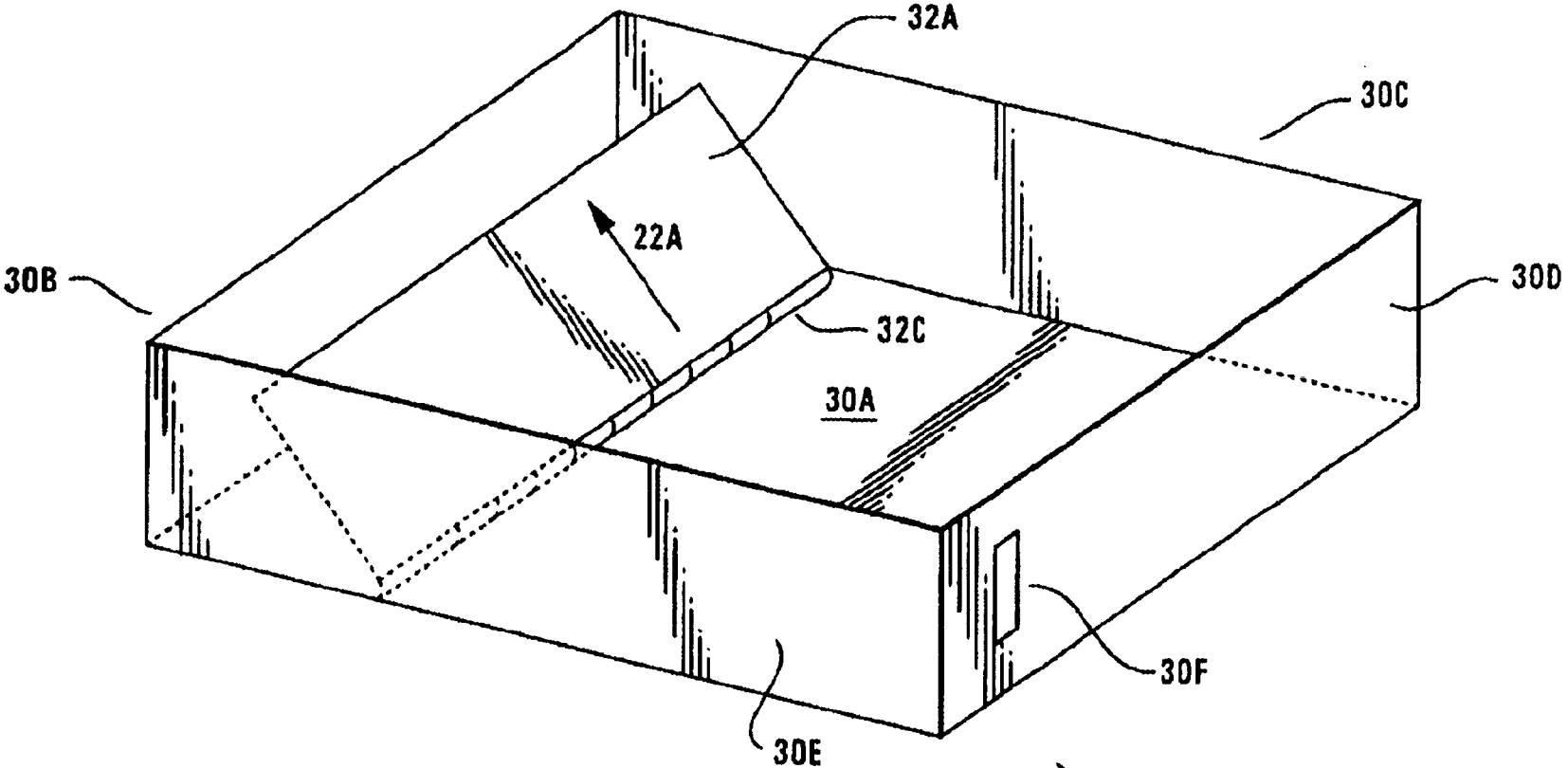
Figure 3 (PRIOR ART)
FIG. 3 is a perspective view of the media holder of FIG. 2.

In the following detailed description and in the several figures of the drawings, like elements are identified with like reference numerals.

The desktop printing industry can benefit greatly from a low-cost device and method, and from low cost media-using-machines that can measure the quantity of media in an input media holder such as an input hopper or input tray. It will be beneficial to measure the quantity of media in such media holders provided that such measurement can be done without significant manufacturing cost to the printer or other machine. Information about media quantity available in a desktop printer may enable automatic notification to the user of the printer to load more media into the printer and may allow the control system of a sheet fed media-using-machine to control functions of the machine based upon the quantity of media available.

The present inventions described below are preferred embodiments and provide various sensory means and methods within a desktop or other machine to sense the amount of media present in the media holder. A key benefit of the present inventions is that they add little cost to the overall cost of a printer or other media-using-machine. The objects of the present inventions are provided by integrating low cost displacement sensors into media holders, and a preferred embodiment is to integrate the sensor into the previously known media-stack pushing mechanism that functions to push the media stack to a position where the media-using-machine may conveniently withdraw sheets from the media holder.

Figure 8:
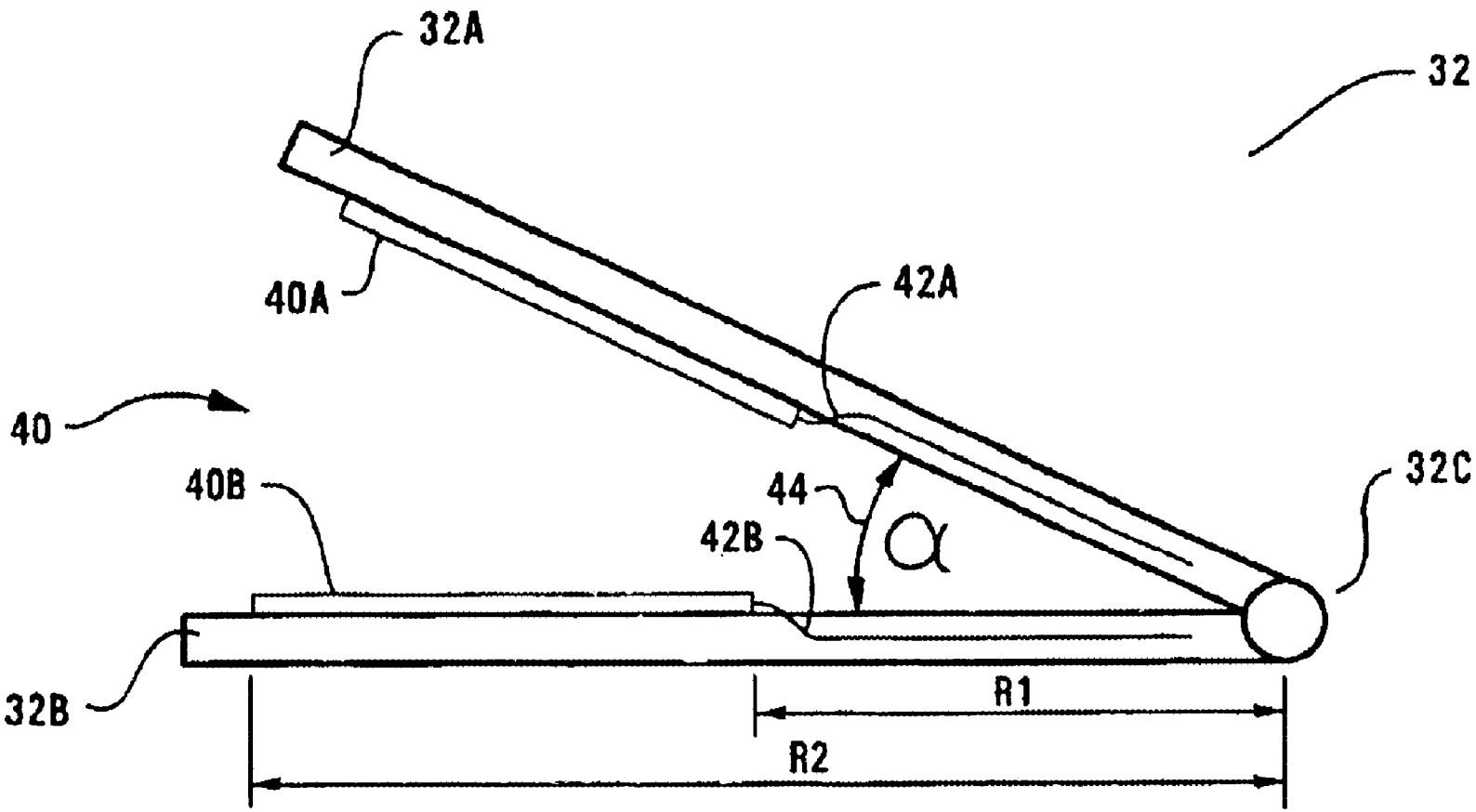
FIG. 8 illustrates an aspect of the present invention, the aspect being a variable capacitor inexpensively used to sense rotational displacement corresponding to the quantity of sheets that are stacked in a media holder of a stack fed media-using-machine of the present invention.

FIG. 8 illustrates an aspect of the present invention; this aspect is variable capacitor 40 which is used to sense the quantity of sheets that are stacked in a media holder 22. This aspect of the present invention may be inexpensively used with media holders 22 of the prior art. In particular, this aspect of the present invention may be conveniently attached to a stack pusher 32 such as those of the prior art that are used to provide a mechanical force to push a stack of media sheets into a position such that the media-using-machine 20 may withdraw the sheets from the media holder 22. Alternatively, a stack pusher 32 may be provided using a similar construction but which serves no other function other than pushing a stack of media sheets such that the quantity of sheets may be measured using the media stack displacement method.of the present invention. In any event, a stack pusher 32 provides a mechanical force upon the media stack such that a difference in the quantity of sheets of a stack causes a difference in the amount of displacement of the stack pusher.

In FIG. 8, variable capacitor 40 is one type of variable device that may be employed by the present invention. In FIG. 8, the variable capacitor will be illustrated in connection with a stack pusher 32 wherein the stack pusher is of the type illustrated in FIGS. 2, 3, 6, and 7 which type employs a hinge 32C to govern the motion of pusher plate 32A relative to pusher base 32B. Such variable devices have properties which may be employed by the present invention. In the case of a variable capacitor, the electrical property is capacitance. Variable capacitor 40 has linked plate 40A which is linked or attached to pusher plate 32A. Linked plate 40A is a conductive element that is structurally mounted on pusher plat 32A. Variable capacitor 40 also has non-linked plate 40B which is not linked or attached to pusher plate 32A. Thus, non-linked plate 40B is a conductive element that is structurally mounted on a structural member of media holder 22 or to a structural member attached to media holder 22. For example, non-linked plate 40B may be attached to tray bottom 30A of a prior art media holder 22 of a prior art media-using-machine 20, or may be mounted, as shown in FIG. 8 to pusher base 32B.

It should be understood that in the embodiment illustrated in FIG. 8, and in other embodiments, linked plate 40A and non-linked plate 40B may be substantially two dimensional as needed to provide plate surface area in order to achieve the desired capacitance (range) of variable capacitor 40. In other words, the plates 40A and 40B may extend in a direction into the illustration page such that the plates have both length and breadth.

Linked plate wire 42A provides an electrical communication path from linked plate 40A to a capacitance measuring circuit (the circuit is shown in a subsequent figure, FIG. 13) while non-linked plate wire 42B provides an electrical communication path from non-linked plate 40B to the capacitance measuring circuit.

In FIG. 8, pusher plate 32A is disposed at an angle $\alpha$ with respect to pusher base 32B and with respect to tray bottom 30A, the vertex of the angle being defined by hinge 32C. Linked plate 40A and non-linked plate 40B extend from one radius $R_1$ to another radius $R_2$, where $R_2$ is greater than $R_1$ and each of the radii are measured from hinge 32C.

Figure 6:
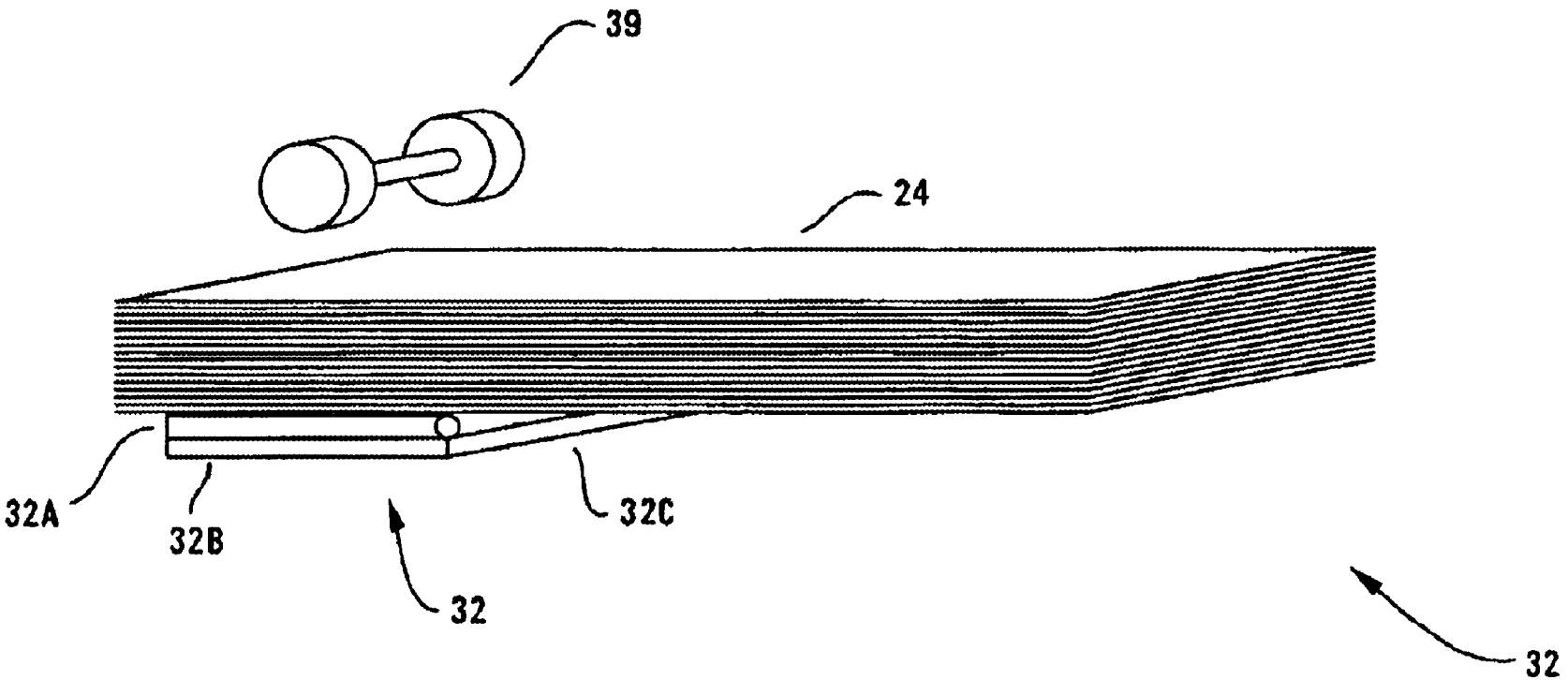
Figure 6 (PRIOR ART)
FIG. 6 illustrates an aspect of a prior art media holder.
Figure 7:
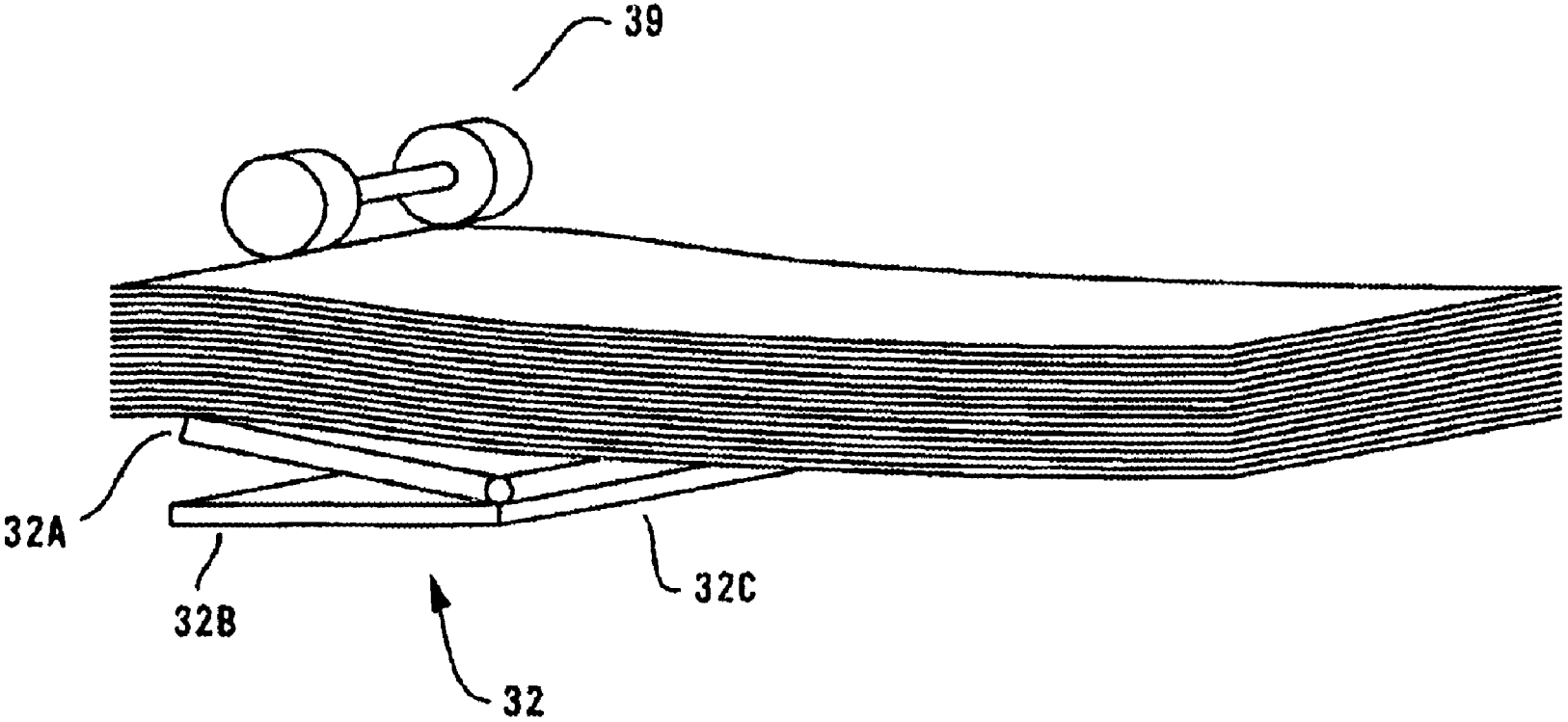
Figure 7 (PRIOR ART)
FIG. 7 illustrates an aspect of a prior art media holder

It is well known in the prior art how to use capacitance to measure changes in relative separation of two electrodes. The present inventions employ this principle to sense the relative amount to which the media pusher 32 displaces media stack 24. The capacitance of the electrode pair (40A and 40B) can be calibrated at the non-displaced position corresponding to a full media stack 24 (as illustrated in FIG. 6), calibrated at a fully displaced position corresponding to a media holder 22 holding no media sheets, and can be calibrated at intermediate displaced positions corresponding to a media stack 24 that is less than full but more then empty (illustrated in FIG. 7). It should be noted that in this embodiment, angle $\alpha$ varies from its minimum angle when media holder 22 is full to its maximum angle when media holder 22 is empty of media stack 24.

The general model of a parallel plate capacitor is given by the well known formula where capacitance in the ideal case is given by Eq. (1)

$$C = A\in_r\in_0/d \tag{1}$$

where A is the area in square meters of one of the plates, d is the distance in meters between the plates, $\in_0$ is the permittivity of empty space with the numerical value of $8.85\times10^{-12}$ farad/m, and $\in_r$ is the relative permittivity of the dielectric material between the plates. In this embodiment, the dielectric material is air and for air, $\in_r$ is nearly unity. It should be understood that electrodes 40A and 40B may be covered with a protective paper, plastic, or other layer and such a layer would affect result in a composite dielectric material consisting of both air and the protective layer, resulting in a different $\in_r$. In fact, electrodes 40A and 40B may be disposed such that one of the electrodes is located on one side of media stack 24 while the other electrode is located on the other side of media stack 24. An example of this type of location would be to place non-linked plate 40B in the media-using-machine at the location which would comprise a roof of media tray 22 when media tray 22 is inserted into the media-using-machine. Another example would be when a slot rather than a tray is used. The non-linked electrode 40B may be disposed on one side of the thickness dimension of the slot while the linked electrode may be disposed on the other side of the thickness dimension. By "thickness dimension" the inventor means that dimension that becomes increasingly occupied as the slot becomes increasingly filled with paper. It should be noted that in a slot type arrangement, it would be feasible to have both electrodes be "linked" electrodes, that is, one electrode may be on one side of the media stack 24 while the other electrode being on the other side of the media stack 24. The media would serve as the dielectric and the varying thickness of the media stack 24 would result in varying capacitance.

In the embodiment of FIG. 8, it may be observed that electrodes 40A and 40B are not parallel but are instead disposed at the varying angle $\alpha$. This will result in capacitive behavior in variable capacitance that is different from that modeled in Eq. 1 and better expressed in Eq. 2 for an ideal case:

$$C=\in_r\in_0 l/\alpha \ln R_2/R_1 \quad (2)$$

where l is the dimension of electrodes 40A and 40B perpendicular to the page of FIG. 8.

We may expect that the opposite charges on the respective opposite electrodes will not be equally distributed on the electrodes but instead will migrate to the vicinity of the plates that are closest to each other until an equilibrium is reached. In other words, the charge will migrate to areas that are closer to hinge 32C since opposite charge attracts. As angle $\alpha$ becomes greater, such migration will become more pronounced. As angle $\alpha$ becomes closest to zero such migration will become less pronounced and there will be a more uniform distribution of charge on the plates since electrodes 40A and 40B become very close to parallel. The non-ideal behavior of the variable capacitor 40 of the present embodiment, and of other embodiments described herein simply means that the capacitive behavior of the variable capacitor should be empirically determined and an appropriate conversion circuit, lookup table, or conversion expression employed for conversion of measured capacitance values to media quantities.

Figure 9:
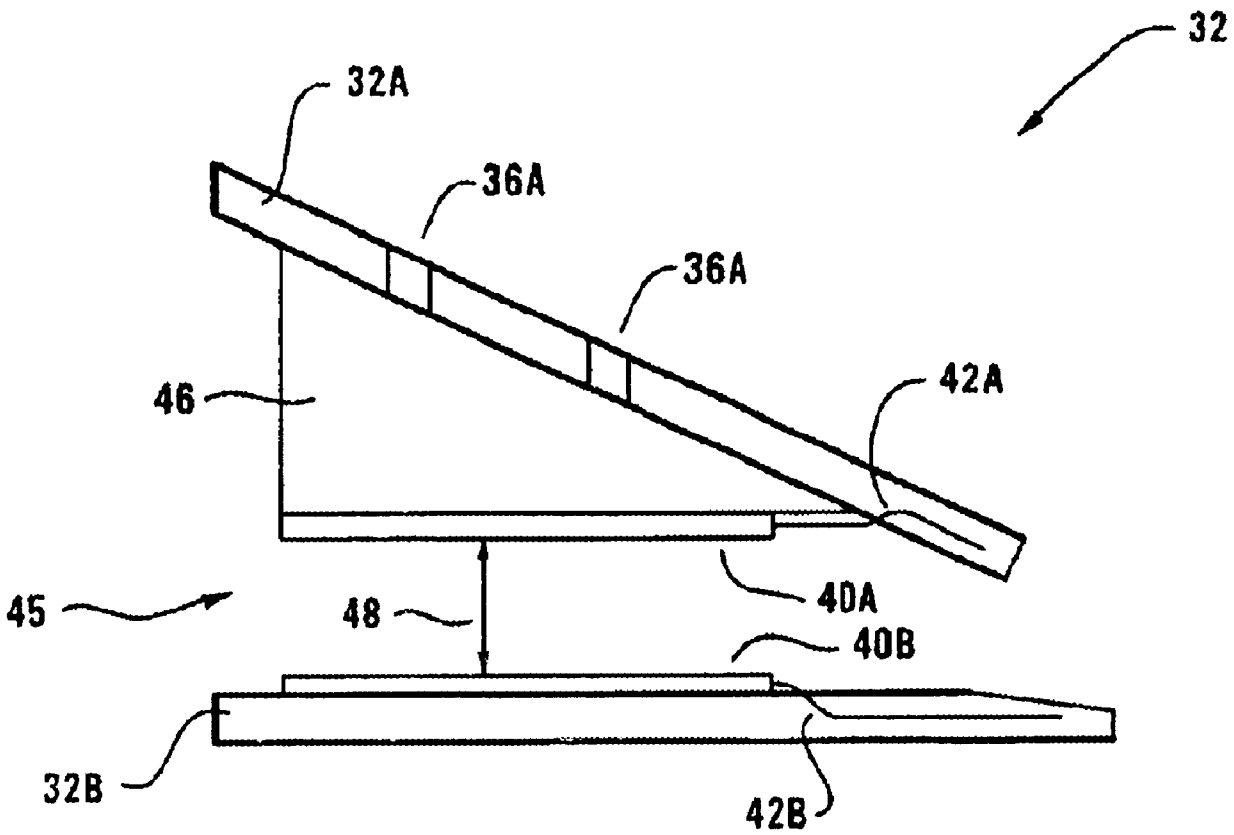
FIG. 9 illustrates an aspect of the present invention, the aspect being a variable capacitor inexpensively used to sense translational displacement corresponding to the quantity of sheets that are stacked in a media holder of a stack fed media-using-machine of the present invention.

FIG. 9 illustrates an aspect of the present invention; this aspect is variable capacitor 45, which is used to sense the quantity of sheets that are stacked in a media holder. This aspect of the present invention may also be inexpensively used with media holders 22 of the prior art. In particular, this aspect of the present invention may also be conveniently attached to a stack pusher 32 such as those of the prior art.

In FIG. 9, variable capacitor 45 is a one type of variable device that may be employed by the present invention. In FIG. 9, the variable capacitor will be illustrated in connection with a stack pusher 32 wherein the stack pusher is of the type illustrated in FIGS. 4 and 5 which type employs tabs 36A with slots 36B or which employ some other means to provide translational (as opposed to rotational) movement of pusher plate 32A relative to pusher base 32B. Variable capacitor 45 has linked plate 40A which is linked or attached to pusher plate 32A. Variable capacitor 45 also has non-linked plate 40B which is not linked or attached to pusher plate 32A. For example, non-linked plate 40B may be attached to tray bottom 30A of a prior art media holder 22 of a prior art media-using-machine 20. Linked plate wire 42A and non-linked plate wire 42B serve the same function as described for these elements in connection with FIG. 8. Shim 46 may be provided to make linked plate 40A and non-linked plate 40B parallel or more close to parallel. Shim 46 may be attached to and sandwiched between pusher plate 32A and linked plate 40A. Since displacement of media pusher 32A of FIG. 9 is translational rather than rotational, the parallelism provided by shim 46 is maintained at different displacements.

FIGS. 8 and 9 illustrate variable capacitors 40 and 45 of the present invention that rely upon the principle that capacitance changes with a change in the distance between two plates of a capacitor. That is, as the linked plate 40A is displaced by either rotational or translational displacement further away from the non-linked plate 40B, capacitance of variable capacitor 40 or 45 decreases in accordance with an increasing d in Eq. 1, above, or increasing $\theta$ in Eq. 2, above, while the converse is true in the case in which linked plate 40A is displaced closer to non-linked plate 40B.

FIG. 10 illustrates a different aspect of the present invention. This aspect relies upon the principle that capacitance changes with a change in the amount of overlapping surface area of a capacitor. This corresponds to an increase in A of Eq. 1 resulting in an increase of C. FIG. 10A illustrates variable capacitor 50 which is used to sense the quantity of sheets that are stacked in a media holder. This aspect of the present invention may also be inexpensively used with media holders 22 of the prior art. In particular, this aspect of the present invention may also be conveniently attached to a stack pusher 32 such as those of the prior art. This aspect of the intention can be used with stack pushers 32 that rely on either translational displacement or rotational displacement.

Figure 4:
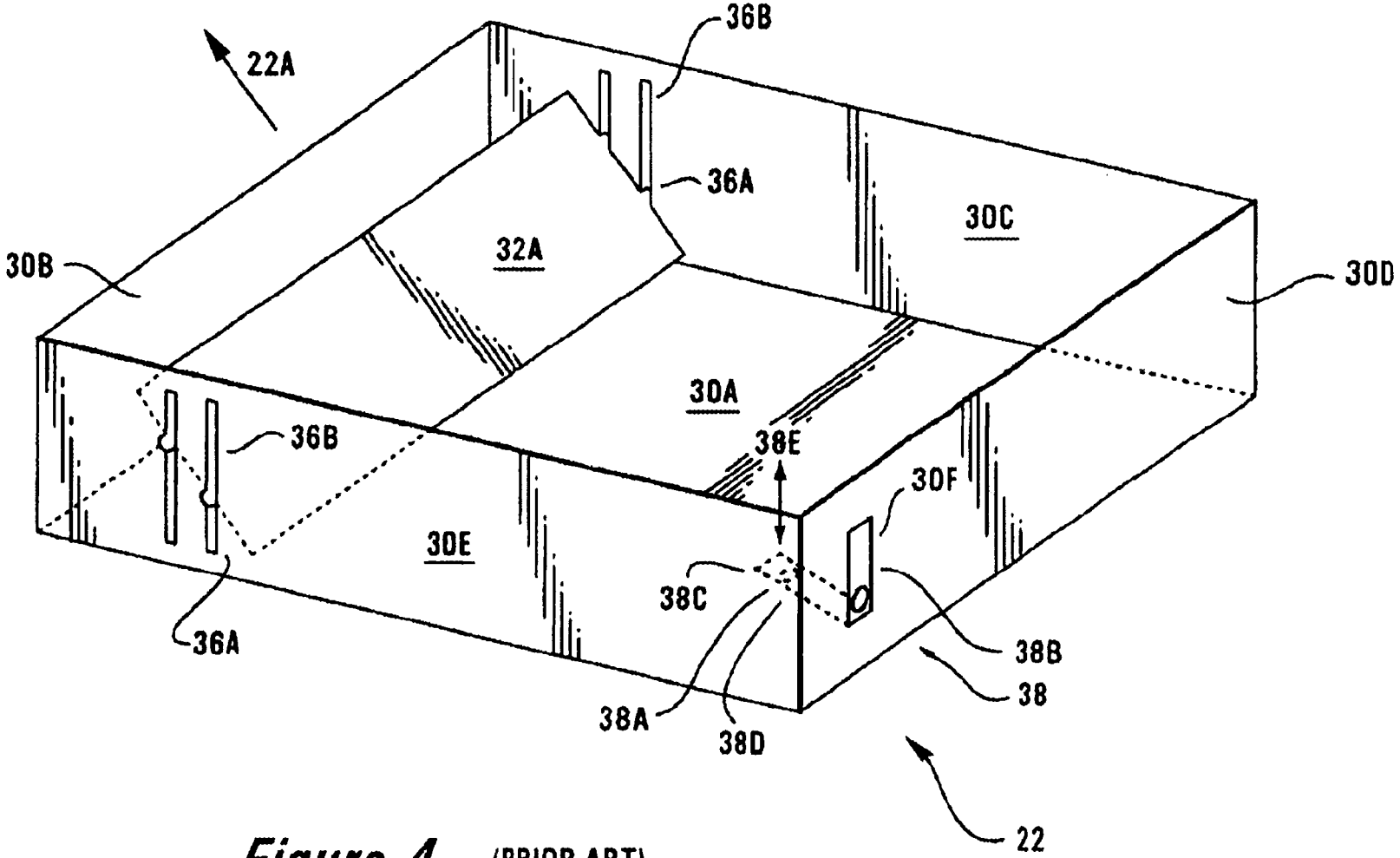
Figure 4 (PRIOR ART)
FIGS. 4 is perspective view of another prior art media holder.
Figure 5:
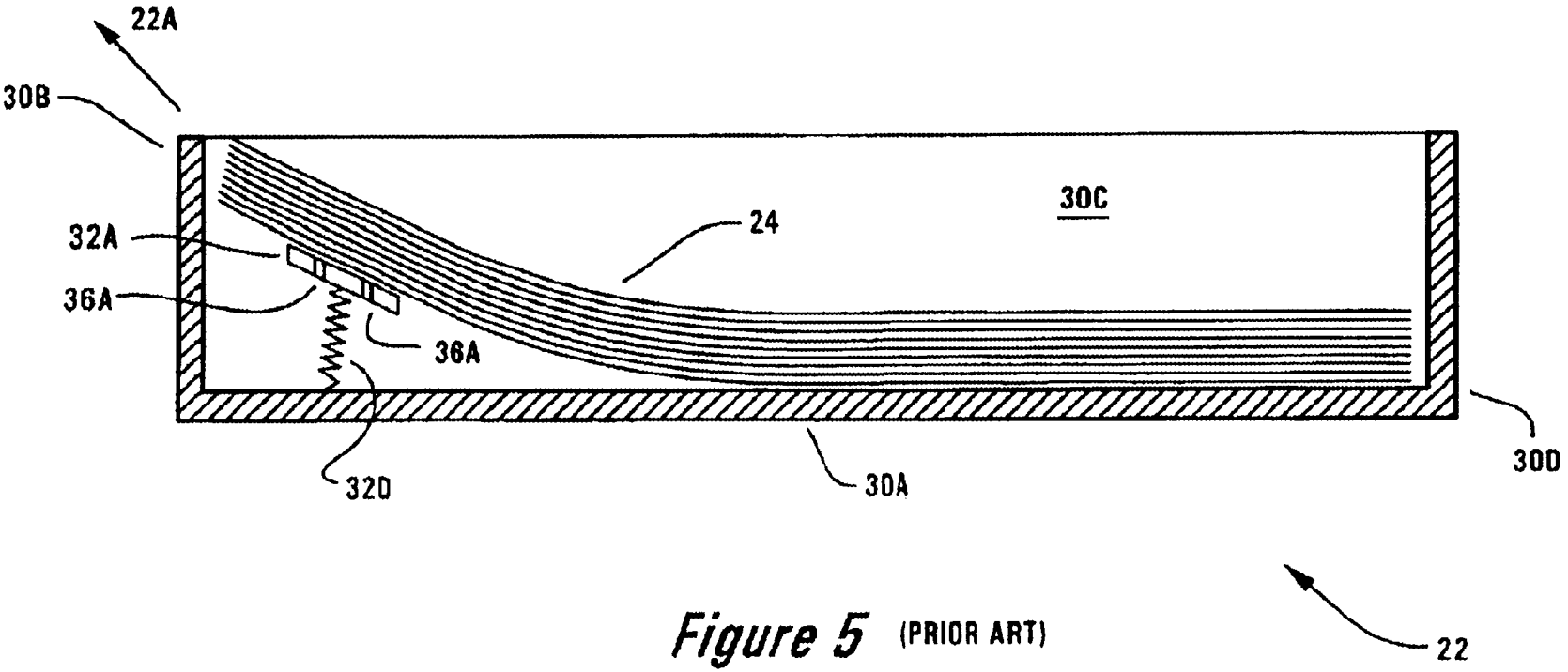
Figure 5 (PRIOR ART)
FIG. 5 is cut-away view which provides further details of the prior art media holder of FIG. 4.

In FIG. 10, variable capacitor 50 is illustrated in connection with a stack pusher 32 wherein the stack pusher is of the type illustrated in FIGS. 4 and 5 which type employs tabs 36A with slots 36B or which employ some other means to provide translational displacement although, as mentioned above, this embodiment may be used with stack pushers 32 that employ rotational type displacement. Variable capacitor 50 has linked plate 50A which is linked or attached to pusher plate 32A. Linked plate 50A is disposed such that it is parallel to tray sides 30C and 30E.

Variable capacitor 50 also has non-linked plate 50B which is not linked or attached to pusher plate 32A. For example, non-linked plate 50B may be attached to tray bottom 30A of a prior art media holder 22 of a prior art media-using-machine 20. Non-linked plate 50B is disposed such that it is parallel to tray sides 30C and 30E and parallel to linked plate 50A.

The principle of operation of variable capacitor 50 is that when pusher plate 32A is displaced to be closer to pusher base 32B there is a greater area of overlap for linked plate 50A and non-linked plate 50B. This greater area of overlap causes the capacitance of variable capacitor 50 to increase with increasing A, somewhat as in Eq. 1.

In these and the following embodiments of the present invention, linked plate wire 42A and non-linked plate wire 42B are not necessarily shown but instead are omitted for clarity. It should be understood that such wires are used with other embodiments of the invention to connect the capacitor plates to a capacitance measuring circuit (shown in a subsequent figure, FIG. 13).

Figure 10A:
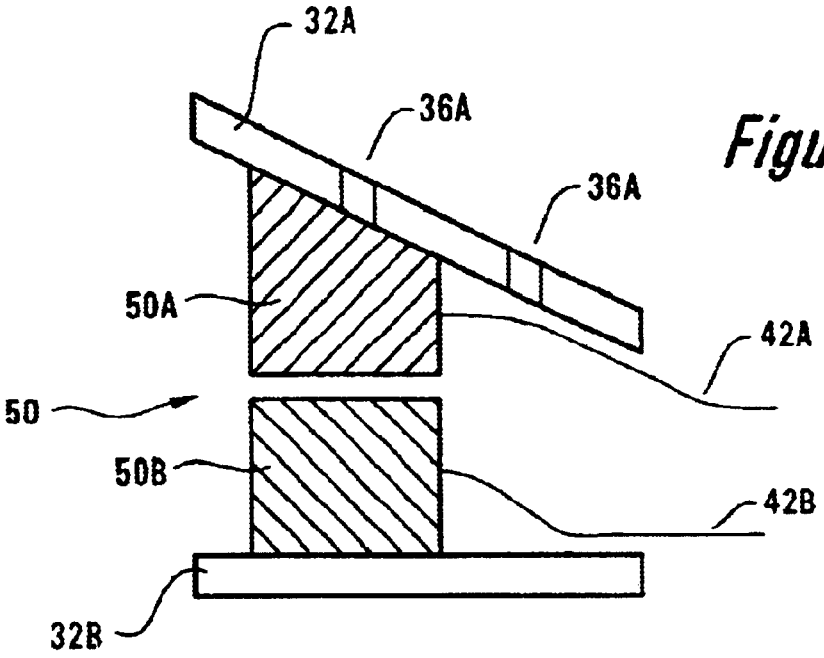
FIG. 10 illustrates a different translational displacement embodiment of a stack fed media-using-machine of the present invention.
Figure 10B:
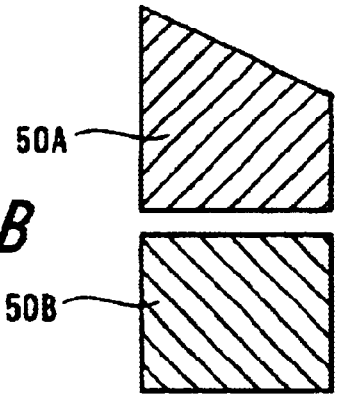
Figure 10C:
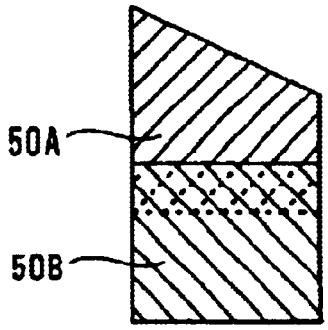
Figure 10D:
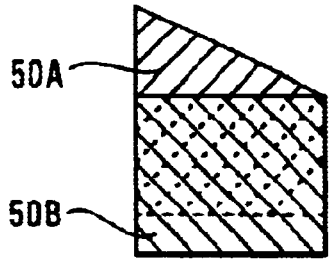

FIGS. 10B, 10C, and 10D illustrate linked plate 50A and non-linked plate 50B in positions of no overlap, partial overlap, and full overlap, respectively. These correspond to pusher plate 32A being not displaced, partially displaced, and fully displaced towards pusher base 32B which in turn correspond to an empty, partially full, and a completely full media tray 22, respectively.

Linked plate wire 42A and non-linked plate wire 42B serve the same function as described for these elements with in connection with FIG. 8. Shim 46 of FIG. 9 may be provided to make linked plate 50A and non-linked plate 50B parallel or more close to parallel. Shim 46 may be attached to and sandwiched between pusher plate 32A and linked plate 50A.

In the embodiments of the present invention illustrated by FIGS. 8, 9, and 10, a direct linking means was used to link the linked plate of the variable capacitor to the media pushing surface.

Figure 11:
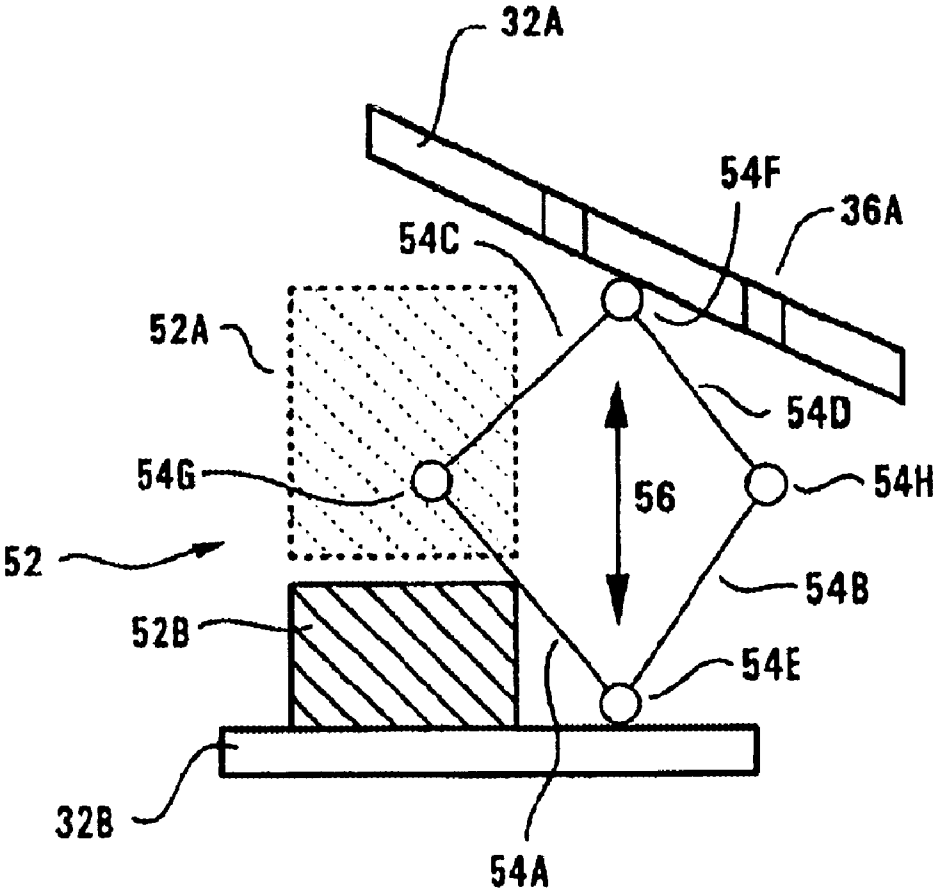
FIG. 11 illustrates a variable capacitor that is indirectly linked to a media pusher of a stack fed media-using-machine of the present invention.

FIG. 11 illustrates an indirect linkage between pusher plate 32A and a linked plate 52A of variable capacitor 52. Variable capacitor 52 is generally similar to the variable capacitor of FIG. 10, that is, they both rely upon the overlapping surface area principle. Linkage 54 is constructed of four rigid link arms 54A, 54B, 54C, and 54D as well as four link pivots 54E, 54F, 54G, and 54H. Link arms 54A and 54B are pivotally attached to pusher base 32B with link pivot 54E. Link arms 54C and 54D are pivotally attached to pusher plate 32A with link pivot 54F. Link arms 54A and 54C are pivotally attached to each other with link pivot 54G. Link arms 54B and 54D are pivotally attached to each other with link pivot 54H. Double arrow 56 illustrates the displacement that is transmitted by linkage 54 from pusher plate 32A to linked plate 52A of variable capacitor 52. As linked plate 52A is displaced downward, there is a greater area of common overlap with non-linked plate 52B and a corresponding increase in capacitance.

It should be understood that an indirect linkage of the present invention could be constructed by using a media pusher of the type of indicator lever 38A as described in connection with FIG. 4. This would be an instance of a stack pusher (indicator lever 38A) serving no other function other than pushing a stack of media sheets such that the quantity of sheets may be measured using the present invention, which was alluded to in connection with FIG. 8.

Figure 12:
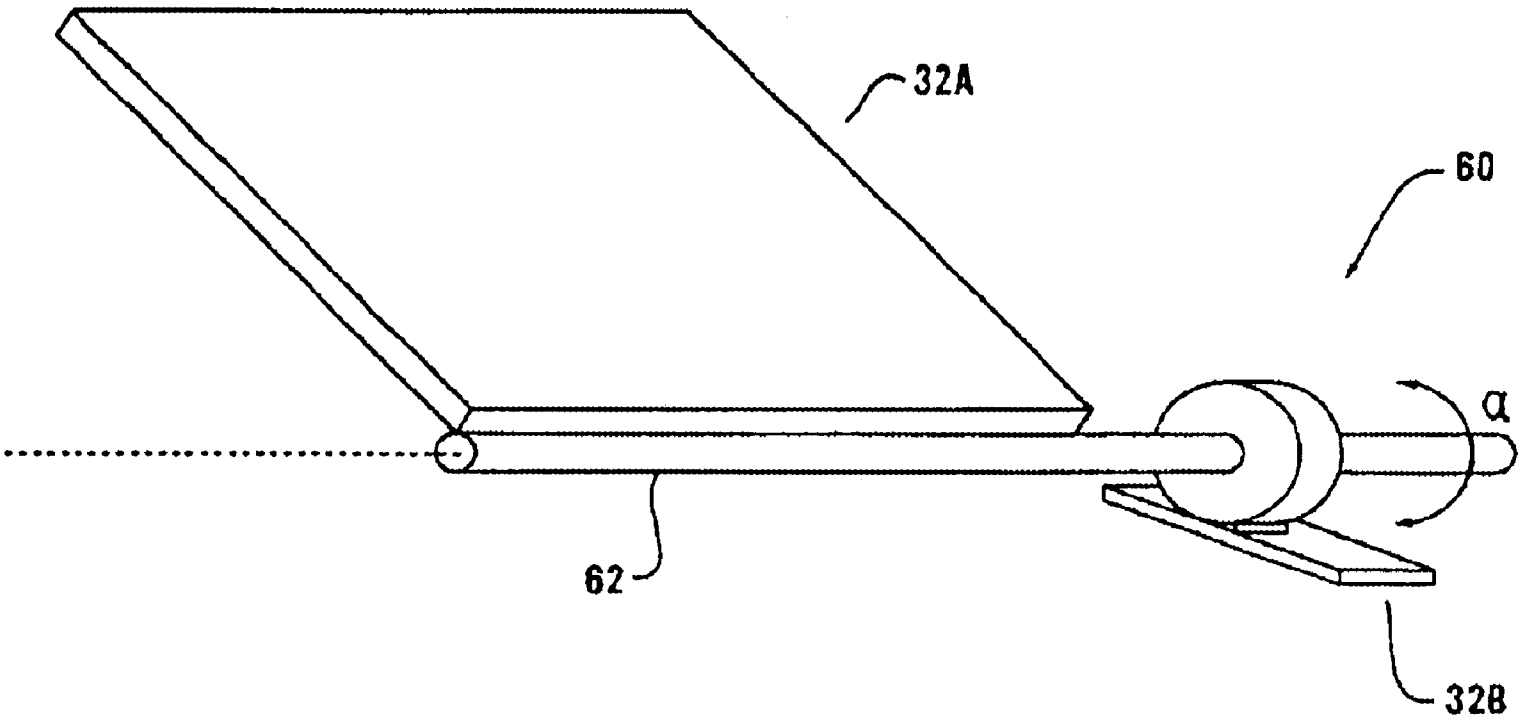
FIG. 12 illustrates a form of rotational linkage between a stack pusher of the present invention and a variable device of the present invention.

FIG. 12 illustrates yet another form of linkage between stack pusher 32A and a variable device 60 of the present invention. Rod 62, which may be a part of a hinge mechanism, provides an axis about which stack pusher 32A may rotate. Rod 62 is attached to a movable part of variable device 60. Variable device 60 is attached to a part of the structure of media holder 22, such as attached to pusher base 32B. Variable device 60 may be a variable capacitor of the well known type having a set of parallel plates connected to comprise a capacitor electrode, with a similar set of parallel plates connected to constitute a second electrode, wherein the sets of plates are interleaved and wherein relative rotation of the sets causes a change in overlapping surface area and thus a change in capacitance. Alternatively, variable device 60 may be a resistance potentiometer, or any other device used to measure rotational positions or displacements.

The description of the present invention has described sensors embodied as capacitive plates that vary in capacitance with angle of rotation, capacitive plates that vary with area of overlap, translational displacement and rotational displacement sensors, as well as direct and indirect linkages. It should be understood that other mechanical displacement embodiments and other sensing elements (such as magnetic proximity sensors, optical-transmissive sensors, optical-reflective sensors, etc.) may be devised that are within the scope of the invention. It is desired that the embodiment depend upon displacement of media stack 24 and a monotonic relationship between the amount of displacement and the value produced by the sensor.

Figure 13:
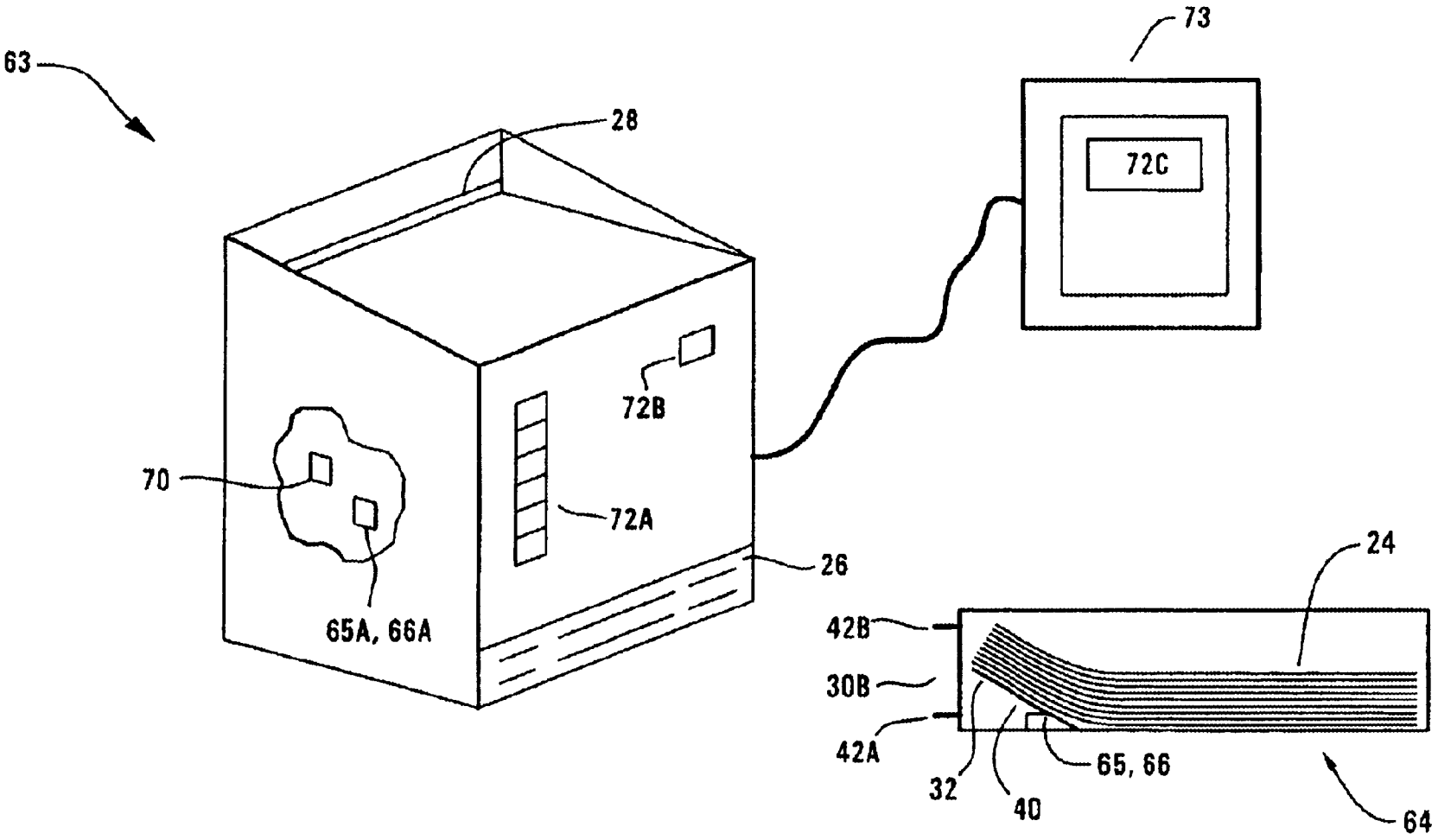
FIG. 13 illustrates a perspective view of a media-using-machine of the present invention.

FIG. 13 is a perspective view of a media-using-machine 63 of the present invention. The media-using-machine 63 of the present invention has media holder 64 which incorporates the present invention as described in FIGS. 8 to 12. Media holder 64 includes stack pusher 32, a variable device which will be discussed in terms of variable capacitor 40.

Linked plate wire 42A and non-linked plate wire 42B have terminals located at front side 30B and there is a corresponding set of terminals (not shown) in holder slot 26 that mate with 42A and 42B when media holder 64 is inserted into holder slot 26. The terminals in holder slot 26 are not shown but will be referred to as the "on-machine terminals" in contrast to those for 42A and 42B which are referred to as the "on-holder terminals."

Measuring device 65 is a capacitance measuring circuit, located on media holder 22, that measures changes in the capacitance of variable capacitor 40. Measuring device 65 may be supplemented with value translator 66, also located on media holder 22. Value translator 66 is a processor, or a part of a processor, and uses the capacitance value that is measured by measuring device 65 and translates the capacitance value into a quantity of pages value. In one embodiment, value translator 66 makes a determination of a quantity of pages value, or makes a determination of an estimate of quantity of sheets, by using digital methods as by calculation. In another embodiment, value translator 66 uses analog methods for to make this determination.

In an embodiment of the present invention having measuring device 65 and value translator 66 located on media holder 22, it should be understood that the on-machine terminals 42A and 42B are used to transmit the translated quantity of sheets from media holder 22 to stack the fed media-using-machine 63. It should be further understood that measuring device 65 and value translator 66 may conveniently be provided and located not on media holder 22 but instead on media-using-machine 63 as is indicated by reference numerals 65A and 66A. In such an instance, on-holder terminals 42A and 42B simply transmit electrical signals from variable capacitor 40, which is on media holder 22, to the measuring device 65A and translator 66 which are located within the media-using-machine 63 and not on the media holder 22.

It should be mentioned that value translator 66 will not necessarily create an output that is an integer number as the quantity of sheets in media holder 22. For example, since the ability of value translator 66 to resolve a measured value into a number of sheets may be limited, value translator 66 may produce an output that is along the lines of quintiles of fullness, such as 100%, 80%, 40%, 20%, 0% full. Depending upon resolution, deciles could be used, and so forth. An integer number could be output with the user understanding that the integer number may only be an approximation, depending upon the resolution provided by value translator 66.

Media control system 70 is a processor which is located within media-using-machine 63. Media control system 70 serves several functions. Media control system 70 provides a quantity display function. In providing the quantity display function, media control system 70 uses the quantity of sheets value (the output) provided by value translator 66 and displays the quantity of sheets on display 72A or display 72B which may be built into the outside structural case housing of the media-using-machine 63. Media control system 70 may also display the quantity of sheets as display 72C on monitor 73 where monitor 73 is either directly attached or networked to media-using-machine 63. Monitor 73 may be a personal computer type monitor that is part of a monitor-keyboard combination of a desk top computer, or may be a similar such monitor.

Media control system 70 is a processor and value translator 66 is a part of the processor. Media control system 70 may update the quantity of sheets value by polling or interrogating measuring device 65 on a basis having a defined period. If a printer has a print rate of six pages per minute, for example, then it would be unnecessary to poll more frequently than once each ten seconds or so since the quantity of sheets could change by only one sheet in such a time interval. Other polling arrangements could be provided, such as polling immediately after media holder 22 is inserted into holder slot 26 and then polling only when sheets are being withdrawn from media holder 22, such as during printing.

In another embodiment, media control system 70 makes an initial determination of an estimate of a quantity of sheets in media stack 24 when media holder 22 is inserted into holder slot 26 and a sheet counter is used to subtract sheets that are printed or otherwise used. Thus media control system 70 may make a determination that media holder 22 is "full" and then a sheet counter (not shown) which is interfaced with media control system 70, counts off sheets as sheets are used. This counting-off-sheets process maintains a current determination of number of sheets in media holder 22 and may be a substitute for polling. Naturally, after a pre-determined number of sheets has been counted-off, media control system 70 may use polling of measuring device 65 in order to use the displacement method of the present invention to prepare an updated determination of the quantity of sheets in media holder 22. In another embodiment, a sheet thickness sensor (not shown) is included within media-using-machine 63 and data from the sheet thickness sensor is provided to media control system 70. Sheet thickness information from a sheet thickness sensor may be used, along with displacement information provided by measuring device 65, to determine a number of sheets in media hopper 22. This determination would use a total stack thickness value measured by measuring device 65 divided by a sheet thickness value to determine a total number of sheets.

Display 72A, 72B and 72C are representative of the various types of displays that may be used by the present invention. The displays that may be used are limited only by the imagination. For example, a thermometer image could provide an analog to the quantity of sheets in media holder 22. A series of ten side-by-side bars could represent quantity of sheets if resolved into deciles. A numerical value may be displayed. Graphical, including pictorial images such as a stack of paper of varying height may be displayed, and so forth.

Media control system 70 also provides a function of low-media quantity intervention. In this aspect, media control system 70 determines if a media using job has been requested of media-using-machine 63. An example of such as job would be to print a document consisting of fifty-two pages. If such a job has been requested, then, before commencing the job, media control system 70 updates the quantity of sheets value, for example, determining that approximately thirty sheets remain in media holder 22. Then media control system 70, compares the number of sheets needed for the job (fifty-two) with the number of sheets remaining in media holder 22 (approximately thirty) and determines that insufficient sheets remain. Media control system 70 then causes a message to be activated. This message activation may be the display of a message, for example message 72C on monitor 73. The message would be to the effect: "You have asked to print a job having fifty-two pages, however, only approximately thirty pages remain in the paper tray. Do you wish to proceed with printing now or do you wish to add paper before proceeding with printing? Please use your computer mouse to click on the appropriate button." Alternatively, an indicator light on media-using machine 63 may be activated, and this light may be supplemented by an audible signal. Adjacent to the activated light may be a legend permanently printed on media-using-machine 63; such a legend being to the effect: "Insufficient Media for Next Job" or "Insufficient Media for Queued Jobs."

One value of the present invention is apparent. Since desk top printers and other devices tend to print at slow speeds, for example at six pages per minute, a job of fifty pages would take more than five minutes. An operator of a media-using-machine 63 may wish to start processing the job and then proceed to undertake other work away from the vicinity of media-using-machine 63, in other word, the operator may wish to leave the machine unattended as it prints the job. In such an event, the operator would be subject to reduced efficiency if the operator were to return several minutes later only to find that a few sheets printed before exhausting the few sheets remaining in media holder 22. The present invention avoids such inefficiencies since the system advises the operator of insufficient sheets before the print job commences. It can also alert an operator at such times that queued print jobs are queued and evaluated against the current media supply in media hopper 22.

Figure 14:
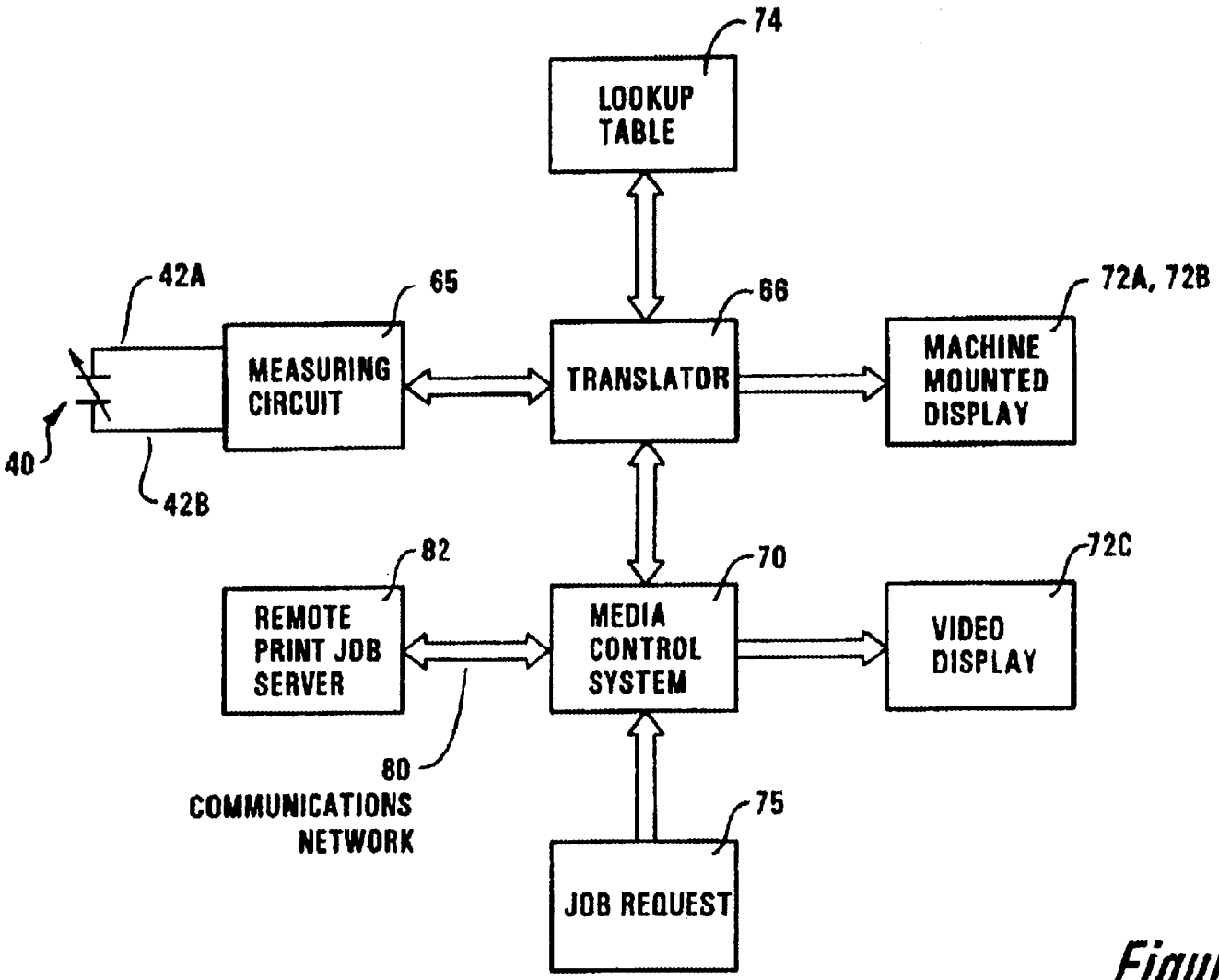
FIG. 14 provides a functional diagram of the electrical function elements of an embodiment of the present invention.

FIG. 14 provides a functional diagram of the electrical functional elements of the present invention. Variable device 40 is illustrated as a variable capacitor connected to capacitance measuring circuit 65 by terminals 42A and 42B. Capacitance measuring circuit 65 provides its output through communication lines to value translator 66. Value translator 66 may refer to lookup table 74, in which case lookup table 74 is either connected to value translator 66 by communication lines or lookup table 74 is integrated into value translator 66. Value translator 66 may be an amplifier, to amplify voltages in order to display capacitance quantities as analogs of page quantity, may be an analog to digital converter to convert capacitance quantities as estimates of page quantities, and so forth. Media control system 70 receives information from job request module 75, such as the number of sheets required by the next job to process, and so forth. Media control system also receives page quantities from value translator 66. Media control system 70 compares such page quantities with the number of sheets required for the next job, as mentioned above. Media control system 70 causes messages, such as the message mentioned in the foregoing paragraph, to be displayed on displays built into media-using-machine 63 (shown in FIG. 13) or on video monitor 72C.

It should be understood that depending upon the amount of system integration, capacitance measuring circuit 65, value translator 66, and media control system 70 may be integrated into fewer discrete devices or one such device. It should be further understood that these circuits may require software in their implementation.

Media control system 70 may be interfaced with a communications network 80 to a remote print-job server 82. Such a remote print-job server would then be a part of an embodiment of the present invention and the server would provide information such as the number of pages of queued jobs, and so forth. The media quantity determination features of the present invention would be provided to remote print-job server 82 by way of communications network 80. The message display features of the present invention may be proved by way of a video display 72C, or a machine mounted display 72A or 72B that is a part of print-job server 82.

Figure 15:
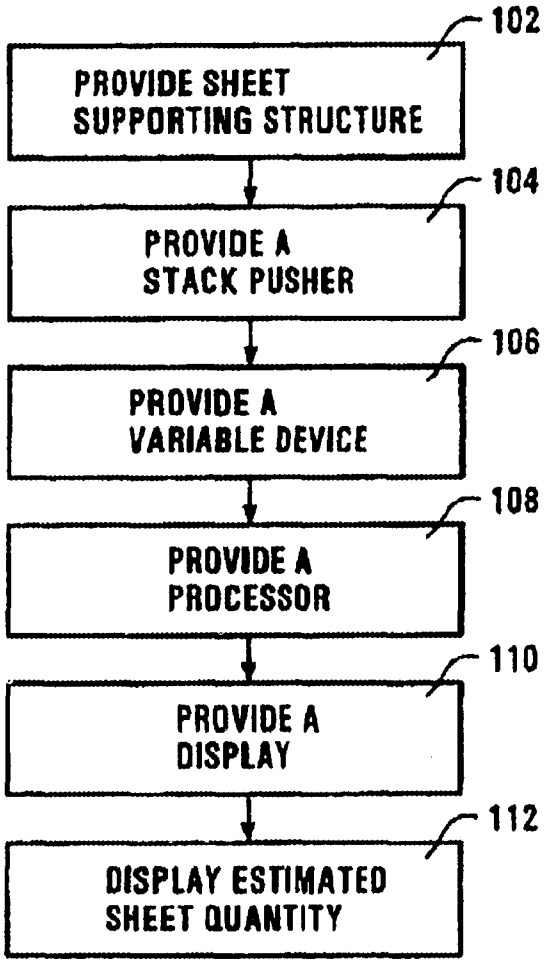
FIGS. 15 and 16 illustrate methods provided by the present invention.

FIG. 15 illustrates a process chart of methods provided by the present invention. One aspect of a method of the present invention is to provide each of the elements of the invention that are described above and use these elements with a machine fed from a stack of sheets. To summarize this process of provision of elements would include the following steps:

Step 102, provide a structure for supporting media sheets. This structure is adapted to be used as a media holder by a sheet fed media-using-machine.

Step 104, provide a stack pusher which is supported by the structure supplied in step 102. The stack pusher will have a variable displacement position within a range of motion wherein such displacement position is dependent upon a quantity of sheets in the stack.

Step 106, provide a variable device attached to the stack pusher such that a measurable property, such as an electrical property of the variable device, varies in relation to the position.

Step 108, provide a processor in communication with the variable device, where the processor calculates an estimate of the quantity of sheets in the stack, and where the calculation is performed using the electrical property of the variable device.

Step 110, provide a display in communication with the processor, such that the display displays the estimate of the quantity of sheets in the stack.

Step 112, use the equipment provided in the foregoing steps to display an estimate of the quantity of sheets in the stack, and to use the estimate of the quantity of sheets as a part of the media using process, such as part of a printing process. The display could be a numerical display, a graphical display such as a bar chart or a pictorial element, or so forth. The display may be a multi-function display such as a video screen.

Figure 16:
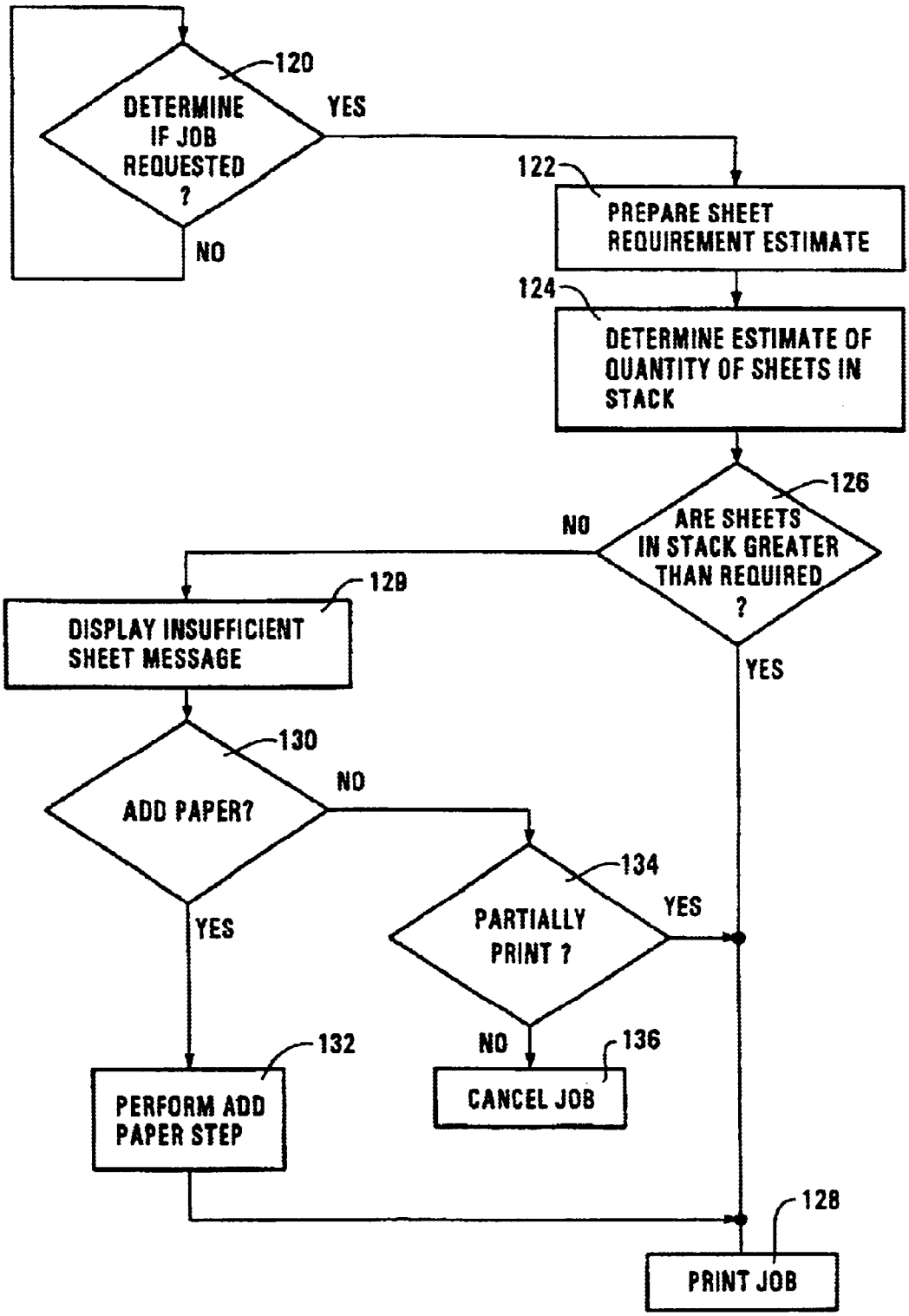

FIG. 16 illustrates a process chart of another method of the invention which may further comprise the following steps:

Step 120, determining if a media using job has been requested of the machine. This determination is done on a periodic basis or may be done as a part of a selected process.

If a media using job has been requested of the machine, then performing step 122 which is preparing a sheet requirement estimate, which is an estimate of the number of sheets that will be used by the job. Then step 124 is performed which is the determination of an estimate of sheets that are in the stack of the media holder, ready to be used by the media-using-machine.

Next, in step 126, comparing the sheet requirement estimate with the estimate of the quantity of sheets in the stack. If the quantity of sheets in the stack is sufficient for the job, then proceed to step 128 in which the job is printed.

If in step 126, the quantity of sheets is not sufficient for the job, then perform step 129 which is display a message to the effect that there is an insufficient quantity of sheets in the media holder to compete the job. Then the operator of the machine can perform step 130 which is to decide whether or not to add paper. If the decision is affirmative, then the operator proceeds to perform step 132 which is to add paper, that is, to add paper. After having added paper, the process continues to step 128 in which the job is fully printed. If the operator makes a negative decision in add paper at decision step 130, then the operator decides in step 134 whether or not to partially print the job. If the answer to this latest decision is "yes" then the process proceeds to step 128 where pages are printed until they are exhausted. If, on the other hand, the operator decides in step 134 not to partially print the job, and the operator has already decided in step 130 not to add paper, then the print job is canceled as step 136.

It should be understood that the foregoing is a summary of the methods of the invention and other aspects of the methods would be to include further elements of the invention that are mentioned above and to use these elements in the manner described above.

Although several embodiments of the present invention have been disclosed and illustrated, the invention is not limited to the specific forms or arrangements of parts so described and illustrated. The invention is only limited by the claims.

What is claimed is:

1. A medium holder for holding a stack of a variable quantity of sheets of a medium to be supplied to a media-using-machine, the media holder comprising:

a structure for supporting the sheets;

a stack pusher, supported by said structure, said stack pusher having a variable displacement position within a range of motion wherein such variable displacement position is dependent upon a quantity of sheets in said stack;

a variable device having a pair of spaced conductive elements and attached to said stack pusher, such that an electrical property of said variable device varies in relation to said variable displacement position of said stack pusher depending upon the quantity of sheets in said stack and as one conductive element moves relative to the other conductive element, thereby allowing determination of an estimate of the quantity of sheets in said stack from the electrical property.

2. The media holder of claim 1 wherein said stack pusher is disposed to push the stack into a position such that said media-using-machine may withdraw the sheets from the stack.

3. The media holder of claim 2 wherein said variable device comprises a variable capacitor and said electrical property comprises a capacitance of said capacitor.

4. The media holder of claim 3 wherein said variable capacitor comprises said first conductive element including a first conductive plate and said second conductive element including a second conductive plate, said first conductive plate is mechanically linked with said stack pusher such that a change in position of said stack pusher causes said first conductive plate to be displaced in relation to said second conductive plate thereby causing the capacitance of the variable capacitor to vary.

5. The media holder of claim 1 wherein said variable device is indirectly coupled to said stack pusher.

6. The media holder of claim 1 wherein said variable device comprises a variable resistor and said electrical property comprises a resistance of said resistor.

7. A media-using-machine fed from a stack of a variable quantity of sheets of a medium, the machine comprising:

a structure for supporting the sheets;

a stack pusher, supported by said structure, said stack pusher having a variable displacement position within a range of motion wherein such variable displacement position is dependent upon a quantity of sheets in said stack;

a variable device having a pair of spaced conductive elements and attached to said stack pusher such that an electrical property of said variable device varies in relation to said variable displacement position of said stack pusher depending upon the quantity of sheets in said stack and as one conductive element moves relative to the other conductive element; and a processor in communication with said variable device, said processor making a determination of an estimate of the quantity of sheets in said stack from the electrical property of said variable device.

8. The machine of claim 7 wherein said stack pusher is disposed to push the stack into a position such that said media-using-machine may withdraw the sheets from the stack.

9. The machine of claim 8 wherein said variable device comprises a variable capacitor and said electrical property comprises a capacitance of said capacitor.

10. The machine of claim 9 wherein said variable capacitor comprises said first conductive element including a first conductive plate and said second conductive element including a second conductive plate, said first conductive plate is mechanically linked with said stack pusher such that a change in position of said stack pusher causes said first conductive plate to be displaced in relation to said second conductive plate thereby causing the capacitance of the variable capacitor to vary.

11. The machine of claim 7 wherein said variable device is indirectly coupled to said stack pusher.

12. The machine of claim 7 wherein said variable device comprises a variable resistor and said electrical property comprises a resistance of said resistor.

13. A method of using a media-using-machine fed from a stack of a variable quantity of sheets of a medium, the method comprising:

providing a structure for supporting the sheets;

providing a stack pusher, supported by said structure, said stack pusher having a variable displacement position within a range of motion wherein such variable displacement position is dependent upon a quantity of sheets in said stack;

providing a variable device having a pair of spaced conductive elements and attached to said stack pusher such that an electrical property of said variable device varies in relation to said variable displacement position of said stack pusher depending upon the quantity of sheets in said stack and as one conductive element moves relative to the other conductive element; and providing a processor in communication with said variable device, said processor making a determination of an estimate of the quantity of sheets in said stack from the electrical property of said variable device.

14. The method of claim 13 further comprising the step of providing a display in communication with said processor, such that the display displays said estimate of the quantity of sheets in said stack.

15. The method of claim 14 wherein said display displays a numerical representation of said estimate.

16. The method of claim 14 wherein said display displays a graphical representation of said estimate.

17. The method of claim 14 wherein said display is a multi-function display and display of said estimate is one such function.

18. The method of claim 17 wherein said display is a video screen.

19. The method of claim 13 further comprising the steps of:

determining if a media using job has been requested of said machine;

if a media using job has been requested of said machine, then preparing a sheet requirement estimate, which is an estimate of the number of sheets that will be used by the job, comparing said sheet requirement estimate with said estimate of the quantity of sheets in said stack, if said estimate of the quantity of sheets in said stack is insufficient to meet said sheet requirement estimate, then causing an insufficient media message to be activated.

20. The method of claim 19 wherein if said estimate of the quantity of sheets in said stack is insufficient to meet said sheet requirement estimate, then further comprising the step of causing said media using job to pause to permit an operator to add additional sheets of media to said machine.

21. A media holder for determining an estimate of a quantity of medium sheets in a stack, comprising:

a base member;

a sheet-pushing member pivotally coupled to the base member and having a variable displacement position from the base member which is dependent on the quantity of sheets in a stack of medium sheets engaged by the sheet-pushing member;

a first conductive element supported by the base member; and a second conductive element supported by the sheet-pushing member such that an electrical property associated with said first and second conductive element varies in relation to said variable displacement position of said sheet-pushing member depending upon the quantity of sheets in said stack and as the second conductive element moves relative to the first conductive element, thereby allowing determination of an estimate of the quantity of sheets in said stack from the electrical property.

22. The media holder of claim 21 additionally comprising a variable capacitor having said first conductive element including a first conductive plate and said second conductive element including a second conductive plate, and wherein a change in position of said sheet-pushing member with respect to said base member causes said first conductive plate to be displaced in relation to said second conductive plate thereby causing the capacitance of the variable capacitor to vary.

23. The media holder of claim 22 wherein said variable capacitor comprises a dielectric disposed between said first conductive plate and said second conductive plate.

24. The media holder of claim 23 wherein said dielectric comprises air.

25. The media holder of claim 21 additionally comprising a shim member connected to said sheet-pushing member and to said second conductive element for paralleling the second conductive element relative to the first conductive element.

26. The media holder of claim 24 additionally comprising a shim member connected to said sheet-pushing member and to said second conductive element for paralleling the second conductive element relative to the first conductive element.

27. The media holder of claim 21 additionally comprising a hinge mechanism for pivotally coupling the base member to the sheet-pushing member.

28. The media holder of claim 26 additionally comprising a hinge mechanism for pivotally coupling the base member to the sheet-pushing member.

29. A method for determining an estimate of a quantity of medium sheets in a stack, comprising:

engaging a stack of medium sheets with a sheet-pushing member supporting a first conductive element and pivotally coupled to a base member supporting a second conductive element;

moving the sheet-pushing member relative to the base member to cause an electrical property associated with said first and second conductive element to vary in relation to a variable displacement position of the sheet-pushing member from the base member depending upon the quantity of sheets in said stack and as the second conductive element moves relative to the first conductive element; and determining an estimate of the quantity of sheets in said stack from the electrical property.

30. The method of claim 29 wherein said first conductive element includes a first conductive plate and said second conductive element includes a second conductive plate.

31. The method of claim 29 additionally comprising overlapping the first conductive element and the second conductive element.

32. The method of claim 30 additionally comprising overlapping the first conductive plate and the second conductive plate.

33. The method of claim 30 additionally comprising forming a variable capacitor with said first conductive plate and said second conductive plate, and overlapping said first conductive plate with said second conductive plate such that the electrical property of the variable capacitor is a capacitance which changes with a change in the amount of overlapping surface area of the first conductive plate with the second conductive plate.

* * * * *